US010337779B2

(12) United States Patent
Watanabe et al.

(10) Patent No.: US 10,337,779 B2
(45) Date of Patent: Jul. 2, 2019

(54) GAS RECOVERY SYSTEM, COMPRESSOR SYSTEM, AND REFRIGERATION CYCLE SYSTEM

(71) Applicant: MITSUBISHI HEAVY INDUSTRIES COMPRESSOR CORPORATION, Tokyo (JP)

(72) Inventors: Takuya Watanabe, Hiroshima (JP); Koichi Mizushita, Hiroshima (JP); Tomoaki Takeda, Hiroshima (JP); Yasushi Mori, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 118 days.

(21) Appl. No.: 15/562,230

(22) PCT Filed: Apr. 27, 2015

(86) PCT No.: PCT/JP2015/062656

§ 371 (c)(1),
(2) Date: Sep. 27, 2017

(87) PCT Pub. No.: WO2016/174706

PCT Pub. Date: Nov. 3, 2016

(65) Prior Publication Data

US 2018/0120007 A1 May 3, 2018

(51) Int. Cl.
*F25B 43/04* (2006.01)
*F25J 1/00* (2006.01)
(Continued)

(52) U.S. Cl.
CPC ..... *F25B 43/043* (2013.01); *F25J 1/0022* (2013.01); *F25J 1/0052* (2013.01); *F25J 1/0236* (2013.01);
(Continued)

(58) Field of Classification Search
CPC ..... F25B 43/043; F25J 3/062; F25J 1/0268; F25J 1/0022; F25J 1/0052; F25J 3/065;
(Continued)

(56) References Cited

U.S. PATENT DOCUMENTS

2003/0073788 A1 4/2003 Golden et al.
2012/0036890 A1 2/2012 Kimble et al.
(Continued)

FOREIGN PATENT DOCUMENTS

EP 3 225 940 A1 10/2017
JP H07-065585 B2 7/1995
(Continued)

OTHER PUBLICATIONS

International Search Report issued in corresponding International Application No. PCT/JP2015/062656 dated Jul. 14, 2015, with translation (4 pages).
(Continued)

*Primary Examiner* — Emmanuel E Duke
(74) *Attorney, Agent, or Firm* — Osha Liang LLP

(57) ABSTRACT

A gas recovery system separates a mixed gas including a process gas and an inert gas. The gas recovery system includes a cooling section for cooling and liquefying the process gas contained in the mixed gas by cooling the mixed gas at a temperature higher than a condensation temperature of the inert gas and lower than a condensation temperature of the process gas, a separating section for separating the cooled mixed gas into the process gas in a liquid state and the inert gas in a gas state, and a process gas recovery line that is connected to the separating section which circulates and gasifies the liquid-state process gas and then supplies the process gas into the a compressor. The mixed gas is formed
(Continued)

by mixing the process gas, which is compressed by the compressor, and the inert gas, which is supplied to a seal portion of the compressor.

8 Claims, 4 Drawing Sheets

(51) Int. Cl.
*F25J 3/06* (2006.01)
*F25J 1/02* (2006.01)
*F04D 29/10* (2006.01)

(52) U.S. Cl.
CPC ..... *F25J 1/0268* (2013.01); *F25J 1/0278* (2013.01); *F25J 1/0279* (2013.01); *F25J 3/062* (2013.01); *F25J 3/064* (2013.01); *F25J 3/065* (2013.01); *F25J 3/066* (2013.01); *F25J 3/0635* (2013.01); *F25J 3/0645* (2013.01); *F25J 3/0685* (2013.01); *F04D 29/104* (2013.01); *F25J 1/025* (2013.01); *F25J 1/0277* (2013.01); *F25J 2210/62* (2013.01); *F25J 2245/02* (2013.01); *F25J 2270/02* (2013.01); *F25J 2270/90* (2013.01); *F25J 2270/904* (2013.01); *F25J 2280/02* (2013.01); *F25J 2290/72* (2013.01)

(58) Field of Classification Search
CPC ..... F25J 3/0209; F25J 1/0278; F25J 3/0685; F25J 1/0236; F25J 3/066; F25J 3/0635; F25J 1/0279; F25J 3/0645; F25J 3/064; F25J 1/0277; F25J 1/025; F25J 2270/904; F25J 2245/02; F25J 2280/02; F25J 2270/02; F25J 2290/72; F25J 2210/62; F25J 2270/90; F04D 29/104
See application file for complete search history.

(56) References Cited

U.S. PATENT DOCUMENTS

| | | | | |
|---|---|---|---|---|
| 2012/0279239 | A1 | 11/2012 | Bernhardt et al. | |
| 2013/0170961 | A1 | 7/2013 | Meucci et al. | |
| 2014/0112855 | A1* | 4/2014 | Mori ..... | B01D 53/1425 423/226 |

FOREIGN PATENT DOCUMENTS

| | | | | |
|---|---|---|---|---|
| JP | 2001-107891 | A | | 4/2001 |
| JP | 2001107891 | A | * | 4/2001 |
| JP | 2004-116903 | A | | 4/2004 |
| JP | 3816066 | B2 | | 8/2006 |
| JP | 2011-144720 | A | | 7/2011 |

OTHER PUBLICATIONS

Written Opinion of the International Searching Authority issued in corresponding International Application No. PCT/JP2015/062656 dated Jul. 14, 2015, with translation (6 pages).

* cited by examiner

GAS RECOVERY SYSTEM, COMPRESSOR SYSTEM, AND REFRIGERATION CYCLE SYSTEM

TECHNICAL FIELD

One or more embodiments of the present invention relates to a gas recovery system, and a compressor system and a refrigeration cycle system including the same.

BACKGROUND

In compressors, a dry gas seal is provided in order to prevent a gas (process gas) compressed inside a compressor from leaking from a gap between a rotating body (rotor) and a stationary body (stator) to the outside at each end portion of a casing. A clean process gas that has passed through a filter and an inert gas for performing sealing such that a minute amount of the process gas does not further leak out from the dry gas seals to an outside bearing are supplied to the dry gas seals. A gas (hereinafter referred to as a mixed gas) in which a minute amount of the process gas, which leaks out from the dry gas seal to the outside, and the aforementioned inert gas are mixed together is discharged as a vent gas from the compressor.

Patent Document 1 discloses a recovered fluorocarbon regeneration method for removing impurities, such as oil and moisture, which are contained in the recovered fluorocarbon, from the recovered fluorocarbon. In this regeneration method, the fluorocarbon is separated from impurities, such as oil and moisture in a liquid state, by heating the recovered fluorocarbon in a liquid state in an evaporator and gasifying the fluorocarbon contained in the recovered fluorocarbon.

CITATION LIST

Patent Literature

Patent Document 1: Japanese Patent No. 3816066

In the above-mentioned compressor, if the mixed gas is discharged as the vent gas from the dry gas seal, it is necessary to additionally supply the process gas in a closed loop system, and the running cost of the compressor will become high by an amount such that the process gas is added.

In a case where the process gas is separated and recovered from the above-mentioned mixed gas using the regeneration method of Patent Document 1, it is necessary to liquefy the mixed gas. For this reason, the running cost of the compressor will be high by the amount of energy required for the liquefied of the mixed gas.

SUMMARY

One or more embodiments of the present invention provide a gas recovery system, and a compressor system and a refrigeration cycle system including the same, capable of reducing the amount of a process gas to be additionally supplied to a compressor, and reducing the running cost of the compressor.

In one or more embodiments, a gas recovery system separates a mixed gas, in which a process gas compressed by a compressor and an inert gas supplied to a seal portion of the compressor are mixed together, into the process gas and the inert gas, to recover the process gas and the inert gas. The gas recovery system includes a cooling section for cooling and liquefying the process gas contained in the mixed gas by cooling the mixed gas at a temperature that is higher than a condensation temperature of the inert gas and lower than a condensation temperature of the process gas; a separating section for separating the mixed gas cooled in the cooling section into the process gas in a liquid state and the inert gas in a gas state; and a process gas recovery line that is connected to the separating section and that circulates and gasifies the liquid-state process gas and then supplies the process gas into the compressor.

According to such a configuration, the mixed gas is cooled in the cooling section until the process gas is liquefied, and the liquid-state process gas and the gas-state inert gas are separated by the separating section, and the process gas is recovered by the process gas recovery line. That is, the process gas and the inert gas in the mixed gas can be separated by cryogenically separating the mixed gas with the cooling section and the separating section. For that reason, the recovered process gas can be returned to the compressor and reused. Hence, the amount of the process gas to be additionally supplied to the compressor can be reduced.

In the gas recovery system according to one or more embodiments, the cooling section may cool the mixed gas by exchanging heat between a liquefied natural gas and the mixed gas.

According to such a configuration, by using the liquefied natural gas in order to cool and condense the mixed gas, cryogenic separation can be performed at an ultralow temperature and at a low pressure. For that reason, the gas-state process gas can be efficiently brought into a liquid state without liquefying most of the inert gas in the mixed gas. Hence, the recovery efficiency of the process gas in the mixed gas can be improved.

In the gas recovery system according to one or more embodiments, the cooling section may cool the mixed gas by exchanging heat between the liquid-state process gas that flows through the process gas recovery line, and the mixed gas.

According to such a configuration, the liquid-state process gas can be heated while cooling the mixed gas by performing heat exchange between the mixed gas and the liquid-state process gas. Hence, the cold energy when cooling the mixed gas can be recovered and can be effectively used as the energy for heating the liquid-state process gas.

The gas recovery system according to one or more embodiments may further include a first compressor that compresses the mixed gas before being supplied to the cooling section.

According to such a configuration, the condensation temperature of the process gas contained in the mixed gas can be raised by raising the pressure of the mixed gas with the first compressor before being supplied to the cooling section. For that reason, the temperature at which the gas-state process gas is cooled by the cooling section for condensation can be suppressed. Hence, the efficiency when liquefying the process gas by the cooling section can be improved.

The gas recovery system according to one or more embodiments may further include a second compressor that compresses the process gas in a gas state that flows through the process gas recovery line.

According to such a configuration, it is possible to return the separated process gas into a high-pressure compressor while setting the low-pressure mixed gas supplied from the compressor to pressure conditions such that the cryogenic separation becomes optimal.

In the gas recovery system according to one or more embodiments, the separating section may store the separated liquid-state process gas, and the gas recovery system may further include a supply adjustment section that supplies the liquid-state process gas to the process gas recovery line such that the liquid level of the liquid-state process gas is maintained at a certain position in the separating section.

According to such a configuration, the gas-state inert gas within the separating section can be prevented from being mixed into the process gas recovery line.

A compressor system, according to one or more embodiments disclosed herein, may include a compressor; and the gas recovery system described above.

A refrigeration cycle system, according to one or more embodiments disclosed herein, may include the compressor system described above.

According to one or more embodiments of the present invention, by separating the process gas from the mixed gas discharged from the seal portion of the compressor to return the process gas to the compressor, the amount of the process gas to be additionally supplied to the compressor can be reduced, and the running cost of the compressor can be reduced.

DETAILED DESCRIPTION OF EMBODIMENTS

Hereinafter, embodiments for carrying out a gas recovery system, and a compressor system and a refrigeration cycle system including the same, will be described with reference to the drawings. However, the invention is not limited only to these embodiments.

Figure 1:
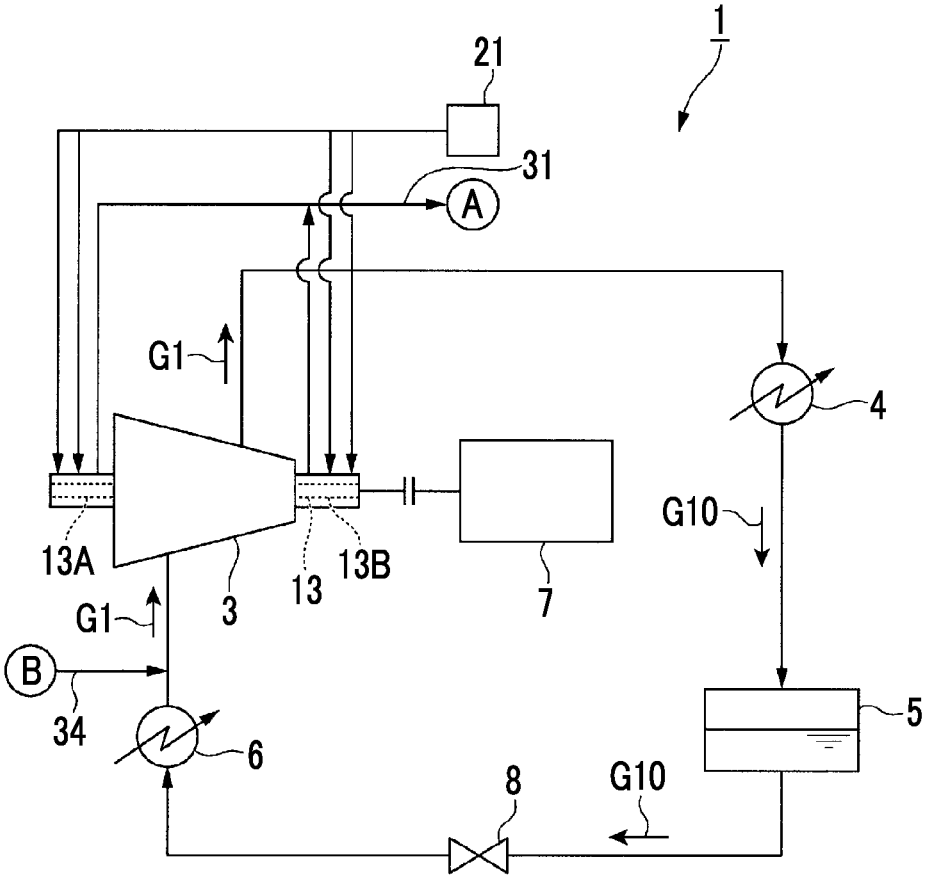
FIG. 1 is a schematic view illustrating a principal section of a refrigeration cycle system related to one or more embodiments of the present invention.

As illustrated in FIG. 1, a refrigeration cycle system 1 according to one or more embodiments is a system for cooling a cooling target (not illustrated). The refrigeration cycle system 1 of one or more embodiments is used for, for example, a liquefied natural gas (hereinafter referred to as LNG) plant. In one or more embodiments, it may be possible to apply the refrigeration cycle system 1 to LNG plants, which excavate natural gas from the seabed to liquefy the natural gas, such as offshore plants or shipboard plants in which it is difficult to replenish the process gas G1 or it is also difficult to secure a space to which a refrigerator is added as a cooling source. The refrigeration cycle system 1 includes a compressor 3, a condenser 4, a storage section 5, and an evaporator 6. These components are connected together by pipelines in the order listed above.

The compressor 3 compresses a refrigerant (hereinafter referred to as a process gas G1) in a gas state. A driving machine 7, such as a motor, which drives a rotor 11 (refer to FIG. 2) of the compressor 3, is connected to the rotor.

The condenser 4 cools and condenses a high-temperature and high-pressure process gas G1 compressed in the compressor 3.

The storage section 5 stores the process gas G1 turning into a liquid state in the condenser 4.

The evaporator 6 exchanges heat between a process gas G10 in a liquid state supplied from the storage section 5 in a state where pressure and temperature have dropped by being adiabatically expanded by a valve 8, and a cooling target (not illustrated), thereby evaporating (gasifying) the liquid-state process gas G10. The gasified process gas G1 is again fed into the compressor 3.

Although the above process gas G1 may be, for example, Freon, the process gas G1 of one or more embodiments is hydrocarbon. The hydrocarbon used as the process gas G1 may be one kind or a plurality of kinds of hydrocarbons appropriately selected from, for example, methane, ethane, propane, butane, and the like.

Figure 2:
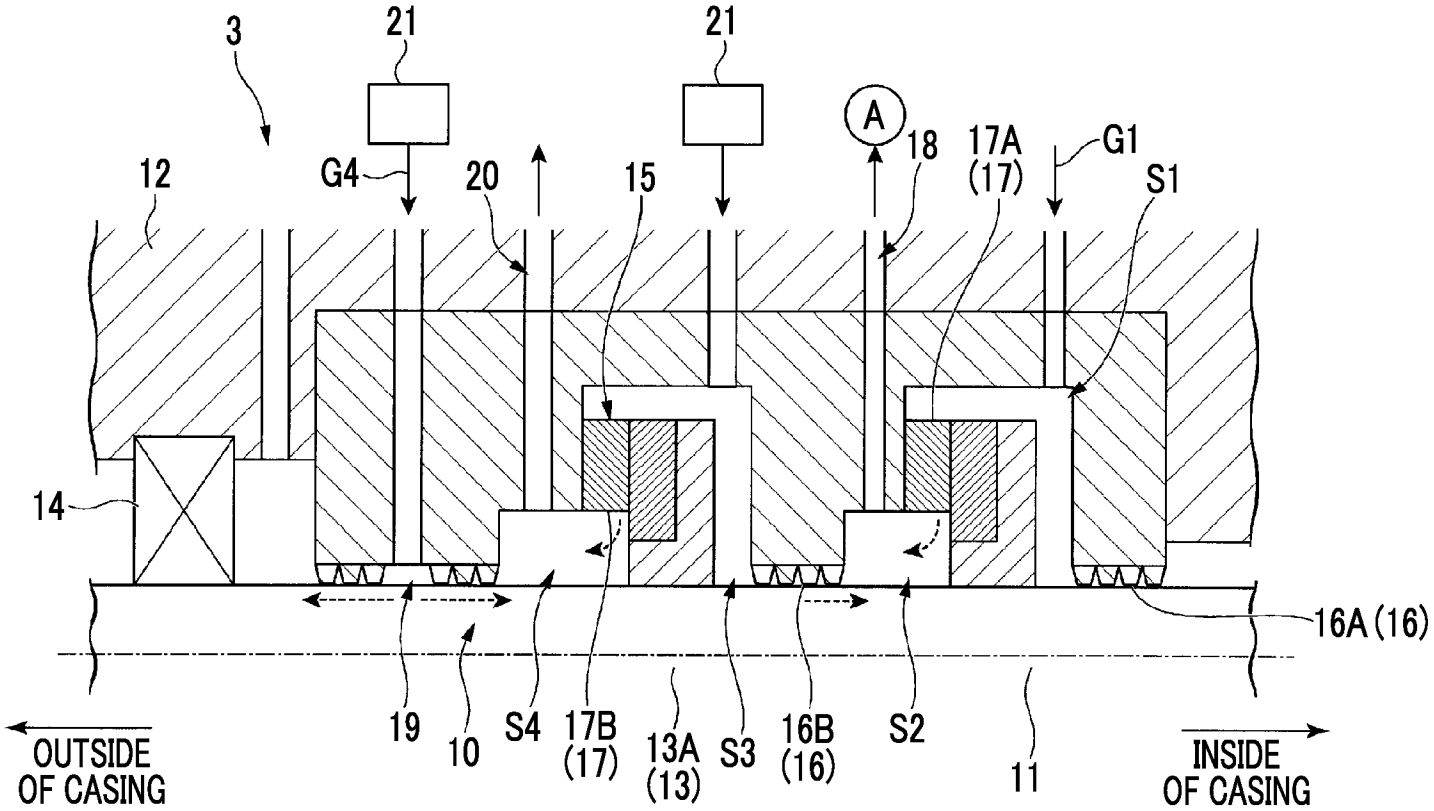
FIG. 2 is a half-sectional view illustrating main parts of a compressor.

As illustrated in FIGS. 1 and 2, the rotor 11 of the above-mentioned compressor 3 includes a rotary shaft 13 and an impeller (not illustrated) attached to this rotary shaft. A stator 12 of the compressor 3 includes a casing (not illustrated) that accommodates the impeller of the rotor 11. The rotary shaft 13 has both a first end portion 13A and a second end portion 13B, which are both ends in an axial direction, protruding to the outside of the casing. The rotary shaft 13 is rotatably supported with respect to the stator 12 by a bearing 14 outside the casing. Although a state where only the first end portion 13A of the rotary shaft 13 in the axial direction is supported with respect to the stator 12 by the bearing 14 is described in FIG. 2, the second end portion 13B of the rotary shaft 13 in the axial direction is similarly supported by the bearing 14.

As illustrated in FIG. 2, a seal portion 10 is provided in a gap between the stator 12 and the rotor 11 in the first end portion 13A and the second end portion 13B of the rotary shaft 13. The seal portion 10 includes a leakage preventing seal portion 15 that prevents the aforementioned process gas G1 from leaking from the inside of the casing to the outside thereof. The leakage preventing seal portion 15 is located inside the casing from the bearing 14 in the axial direction of the rotary shaft 13.

The leakage preventing seal portion 15 includes a plurality of dry gas seals 17. In the leakage preventing seal portion 15, for example, other seals may not be provided between the plurality of dry gas seals 17. However, in these embodiments, a labyrinth seal 16 is provided. Hence, the labyrinth seal 16 and the dry gas seals 17 are included in the leakage preventing seal portion 15. In one or more embodiments, a first labyrinth seal 16A, a first dry gas seal 17A, a second labyrinth seal 16B, and a second dry gas seal 17B are arrayed in order from the inside of the casing to the outside thereof in the axial direction of the rotary shaft 13.

A first space S1 between the first labyrinth seal 16A and the first dry gas seal 17A. A portion of the process gas G1 compressed in the compressor 3 is supplied to the first space S1 through a filter as a first seal gas. By supplying the process gas G1 to the first space S1, the pressure of the first space S1 rises, and leakage of the process gas G1 from the inside of the casing to the first space S1 is prevented.

A second space S2 is formed between the first dry gas seal 17A and the second labyrinth seal 16B. In the second space S2, the process gas G1 leaking out from the first dry gas seal 17A and a second seal gas G2 (to be described below) leaking out from the second labyrinth seal 16B are mixed together. A primary vent 18 for discharging a mixed gas G3, in which the gas-state process gas G1 and the second seal gas G2 are mixed together, to a gas recovery system 30, is connected to the second space S2.

A third space S3 is formed between the second labyrinth seal 16B and the second dry gas seal 17B. The second seal gas (inert gas) G2 is supplied from an external supply source 21 illustrated in FIG. 1 to the third space S3. Accordingly, the pressure of the third space S3 rises, and the process gas G1 that has leaked from the first space S1 through the first dry gas seal 17A to the second space S2 is prevented from leaking through the second labyrinth seal 16B to the third space S3. Meanwhile, the second seal gas G2 supplied to the third space S3 leaks out from the second labyrinth seal 16B, thereby flowing into the second space S2.

The second seal gas G2 may be an inert gas having a lower condensation temperature than the process gas G1. The second seal gas G2 of one or more embodiments is nitrogen.

Additionally, the seal portion 10 further includes a separation seal 19 that is installed between the leakage preventing seal portion 15 and the bearing 14. The separation seal 19 supplies a separation gas G4 in a gas state, thereby preventing the lubricating oil used in the bearing 14 from being mixed into the leakage preventing seal portion 15 including the dry gas seal 17.

Similarly to the second seal gas G2, a separation gas G4 to be used in the separation seal 19 is supplied only from the external supply source 21 illustrated in FIG. 1. Although the separation gas G4 may be an inert gas, the separation gas G4 of one or more embodiments is nitrogen, similarly to the second seal gas G2.

A fourth space S4 is formed between the second dry gas seal 17B and the separation seal 19 in the gap between the stator 12 and the rotor 11. In the fourth space S4, a minute amount of the second seal gas G2 leaking out from the leakage preventing seal portion 15 and the separation gas G4 from the separation seal 19 are mixed together. The mixed gas is discharged from the fourth space S4 via a secondary vent 20 to the outside (for example, into the ambient air).

Although only a state where the seal portion 10 having components, such as the above-mentioned leakage preventing seal portion 15 and separation seal 19, is provided at the first end portion 13A of the rotary shaft 13, is described in FIG. 2, the seal portion 10 having the components, such as the leakage preventing seal portion 15 and the separation seal 19, is similarly provided at the second end portion 13B of the rotary shaft 13.

Figure 3:
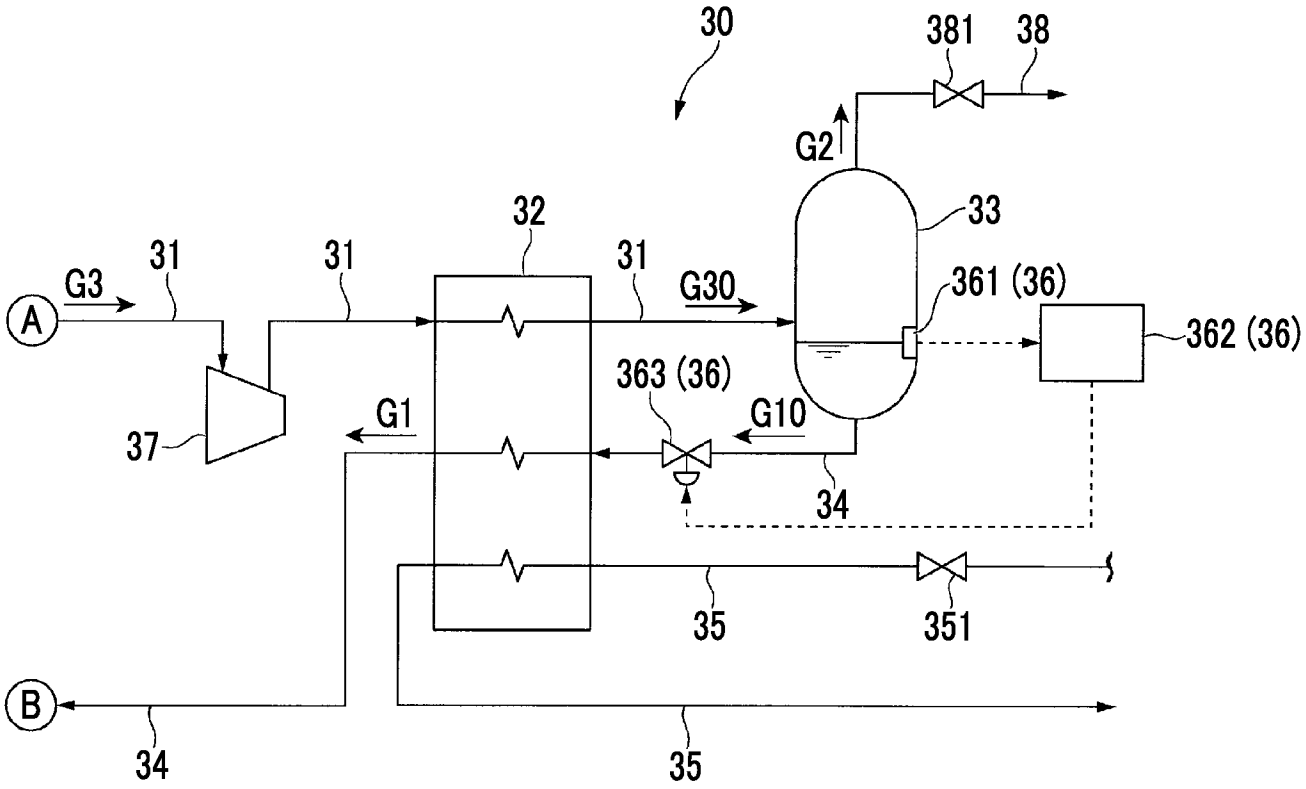
FIG. 3 is a schematic view illustrating a gas recovery system related to one or more embodiments of the present invention.

As illustrated in FIGS. 2 and 3, the refrigeration cycle system 1 of one or more embodiments includes the gas recovery system 30 that separates the mixed gas G3 discharged from the primary vent 18 of the compressor 3 into the process gas G1 and the second seal gas G2 and recovers the separated process gasses. The gas recovery system 30 constitutes the compressor system 2 together with the compressor 3. The gas recovery system 30 includes a mixed gas supply line 31, a cooling section 32, a separating section 33, a process gas recovery line 34, a refrigerant supply line 35, and a supply adjustment section 36.

The mixed gas supply line 31 connects the compressor 3 and the separating section 33 together. The mixed gas supply line 31 supplies the mixed gas G3, in which the gas-state process gas G1 discharged from the compressor 3 and the gas-state second seal gas G2 are present in a mixed manner, to the separating section 33 via the cooling section 32. The mixed gas supply line 31 of one or more embodiments is connected to the primary vent 18 of the compressor 3, passes through the cooling section 32, and is connected to the separating section 33. The mixed gas G3, of which the pressure is about 0.1 to 0.2 bars higher than that of the atmospheric pressure and of which the temperature is about 30° C. to 40° C., flows into the mixed gas supply line 31 of one or more embodiments from the primary vent 18. In the mixed gas supply line 31, a first compressor 37 is provided on the upstream side (compressor 3 side) of the cooling section 32.

The first compressor 37 compresses the mixed gas G3 before being supplied to the cooling section 32. The first compressor 37 is raised in pressure to raise the condensation temperature of the process gas G1 in the mixed gas G3 until the condensation temperature reaches a temperature at which it is possible to efficiently perform condensation in the cooling section 32. The mixed gas G3 compressed by the first compressor 37 is supplied to the cooling section 32 via the mixed gas supply line 31.

In addition, in a case where the mixed gas G3 is largely raised in pressure up to about 8 to 10 bars by the first compressor 37 of one or more embodiments, the temperature of the mixed gas G3 will also be high. Therefore, it may be possible to have a structure in which the pressure-raised mixed gas G3 is cooled before being supplied to the cooling section 32. For example, the mixed gas G3, which is compressed and raised in temperature, may be cooled by providing a cooler between the first compressor 37 and the first cooling section 32 of the mixed gas supply line 31.

The cooling section 32 cools the mixed gas G3 to a temperature that is higher than the condensation temperature of the second seal gas G2 and lower than the condensation temperature of the process gas G1, thereby keeping the second seal gas G2 contained in the mixed gas G3 in a gas state and cooling and liquefying the process gas G1 contained in the mixed gas G3. The cooling section 32 of one or more embodiments is provided in the middle of the mixed gas supply line 31. Specifically, the cooling section 32 is disposed over three lines including the mixed gas supply line 31, the process gas recovery line 34, and the refrigerant supply line 35. The cooling section 32 cools the mixed gas G3 compressed by the first compressor 37 to liquefy the process gas G1 without liquefying most of the second seal gas G2 in the mixed gas G3. The cooling section 32 supplies a second mixed gas G30, which is the mixed gas G3 of the liquefied process gas G1 and the second seal gas G2 that is not liquefied, to the separating section 33. That is, the second mixed gas G30 is in the state of a gas-liquid mixture in which the liquid-state process gas G10 and the gas-state second seal gas G2 are mixed together.

In addition, the mixing conditions of the gas-state second seal gas G2 in the second mixed gas G30 change depending on the condensing pressure in the cooling section 32. For that reason, in a case where it may be possible to raise pressure with a compressor before passing through the cooling section 32 according to allowable mixing conditions of the gas-state second seal gas G2 in the second mixed gas G30, there may be a case where it is possible to perform separation with the compressor after being separated at a low pressure. Specifically, in a case where pressure is raised before passing through the cooling section 32, the condensation temperature rises and condensation is easily performed. However, a ratio in which the nitrogen that is the second seal gas G2 is mixed into the separated second mixed gas G30 will increase. On the other hand, in a case where separation is performed at a low pressure, condensation is not easily performed because the condensation temperature is low. However, the ratio in which the nitrogen that is the second seal gas G2 is mixed into the second mixed gas G30 can be made low. Hence, in a case where mixing of nitrogen is not allowable, separation at a low pressure may be possible. In one or more embodiments, a case where pressure is raised by a compressor before passing through the cooling section 32 is taken as an example.

The cooling section 32 of one or more embodiments exchanges heat with the LNG, thereby cooling the mixed gas G3 *b*. Simultaneously, the cooling section 32 exchanges heat between the liquid-state process gas G10, which flows through the process gas recovery line 34 to be described below, and the mixed gas G3, thereby cooling the mixed gas G3.

Since the temperature of the gas-state process gas G1 is higher than the liquid-state process gas G10, the mixed gas G3 is cooled by the liquid-state process gas G10 that flows through the process gas recovery line 34 in the cooling section 32. Moreover, since the condensation temperature of the process gas G1 is higher than that of the LNG at −150° C. to 160° C., the process gas G1 in the mixed gas G3 is cooled and liquefied by the LNG that flows through the refrigerant supply line 35 in the cooling section 32. As a result, the cooling section 32 supplies, for example, the mixed gas G3 with a temperature of about 30° C. to 40° C. to the separating section 33 as the second mixed gas G30 cooled up to about −150° C. Accordingly, in the cooling section 32, the process gas G1 contained in the mixed gas G3 is cooled and liquefied by exchanging heat between the LNG and the liquid-state process gas G10, and the mixed gas G3. Simultaneously, in the cooling section 32, the LNG that flows through the refrigerant supply line 35 and the liquid-state process gas G10 that flows through the process gas recovery line 34 is heated and gasified.

The second mixed gas G30 is supplied from the cooling section 32 via the mixed gas supply line 31 to the separating section 33. The separating section 33 separates the second mixed gas G30 cooled by the cooling section 32 into the liquid-state process gas G10 and the gas-state second seal gas G2. The separating section 33 of one or more embodiments is formed to extend in a vertical direction, and is formed in such a tubular shape that an upper part and a lower part thereof are blocked. In FIG. 3, although the mixed gas supply line 31 is connected to an intermediate part of the separating section 33 in the vertical direction, the mixed gas supply line may be connected to a suitable height.

The separating section 33 of one or more embodiments is, for example, a separator that has a member, which has a function of allowing gas to pass therethrough while trapping fine mist-like particles like a demister, on a lower side thereof and that stores a liquid on a lower side thereof. That is, in the separating section 33 of one or more embodiments, as the second mixed gas G30 is supplied, the liquid-state process gas G10 is separated downward and the gas-state second seal gas G2 is separated upward. The second seal gas G2 that is separated upward of the separating section 33 and the gas-state process gas G1 that is slightly mixed is discharged outside via a gas discharge line 38 connected to the upper side of the separating section 33. An opening-closing valve 381 is provided in the gas discharge line 38 and is enabled to adjust the flow rate of the second seal gas G2 to be discharged.

The process gas recovery line 34 is connected to a lower part of the separating section 33 and allows the liquid-state process gas G10 accumulated at the lower part of the separating section 33 to be supplied to the compressor 3 after being circulated and gasified therethrough. The process gas recovery line 34 of one or more embodiments passes through the cooling section 32 and is connected to a pipeline between the evaporator 6 and the compressor 3 such that the process gas G1 recovered from the separating section 33 is again compressed in the compressor 3. The process gas recovery line 34 passes through the cooling section 32 and exchanges heat with the mixed gas G3, thereby heating and gasifying the liquid-state process gas G10 that flows through the inside thereof. For example, in the process gas recovery line 34, the liquid-state process gas G10 with about −150° C., which has flowed in from the separating section 33, passes through the cooling section 32, thereby serving as the gas-state process gas G1 with about 20° C. to 30° C.

The supply adjustment section 36 adjusts the amount of the gas-state process gas G1 to return into the compressor 3. The supply adjustment section 36 supplies the liquid-state process gas G10 to the process gas recovery line 34 such that the liquid level of the liquid-state process gas G10 is maintained at a certain position in the separating section 33. The supply adjustment section 36 of one or more embodiments directly adjusts the amount of supply of the liquid-state process gas G10 to be supplied from the separating section 33 to the process gas recovery line 34, and adjusts the amount of the gas-state process gas G1 to return the inside of the compressor 3. The supply adjustment section 36 of one or more embodiments has a detecting unit 361 that is provided in the separating section 33, a control unit 362 to which a detection result is input from the detecting unit 361, and a control valve 363 that is capable of receiving a signal from the control unit 362 and adjusting an opening degree.

The detecting unit 361 detects the position of the liquid level of the liquid-state process gas G10 that is stored, and sends a signal to the control unit 362.

The control unit 362 sends an opening degree instruction to the control valve 363 such that the position of the liquid level of the liquid-state process gas G10 within the separating section 33 is kept constant.

The control valve 363 is provided on the upstream side (separating section 33 side) of the cooling section 32 of the process gas recovery line 34.

The refrigerant supply line 35 supplies the LNG to the cooling section 32 as a refrigerant for cooling the mixed gas G3 with the cooling section 32. The refrigerant supply line 35 of one or more embodiments uses the LNG purified in an LNG plant. In the refrigerant supply line 35, the LNG is heated and gasified by exchanging heat with the mixed gas G3 by the cooling section 32, and is made into a boil-off gas (BOG), is again returned to the LNG plant, and is used for a fuel gas or the like within the plant. An opening-closing valve 351 is provided in the refrigerant supply line 35 and is enabled to adjust the flow rate of the LNG to be supplied to the cooling section 32.

According to the refrigeration cycle systems 1 as described above, the mixed gas G3 in a mixed state discharged from the primary vent 18 of the compressor 3 flows into the mixed gas supply line 31 at a pressure of about 0.1 to 0.2 bars higher than that of the atmospheric pressure and at a temperature of about 30° C. to 40° C. The gas-state mixed gas G3 flows through the mixed gas supply line 31 and is raised in pressure and temperature by the first compressor 37. In this case, as the mixed gas G3 is raised in pressure, the condensation temperature thereof also rises. The mixed gas G3 raised in pressure and temperature in the first compressor 37 is supplied to the cooling section 32. The liquid-state process gas G10 is supplied to the cooling section 32 via the process gas recovery line 34 and the LNG is supplied to the cooling section 32 via the refrigerant supply line 35. For that reason, by passing through the cooling section 32, the mixed gas G3 is cooled to about −150° C. with the liquid-state process gas G10 flowing through the process gas recovery line 34 and the LNG flowing through the refrigerant supply line 35. Specifically, as the mixed gas G3 has a temperature higher than the condensation temperature of the second seal gas G2 and is cooled at a temperature lower than the condensation temperature of the process gas G1, only the process gas G1 is liquefied. For that reason, the second mixed gas G30, which is a gas in a gas-liquid mixed state, is supplied to the separating section 33 via the mixed gas supply line 31.

In the second mixed gas G30 supplied to the separating section 33, the liquid-state process gas G10 is separated downward and the gas-state second seal gas G2 is separated upward. The second seal gas G2 separated upward is discharged to the outside via the gas discharge line 38. The liquid-state process gas G10 stored on the lower side is again supplied to the cooling section 32 via the process gas recovery line 34. The liquid-state process gas G10, which has flowed into the process gas recovery line 34, is heated by passing through the cooling section 32, thereby exchanging heat with the mixed gas G3 flowing through the mixed gas supply line 31. Specifically, the liquid-state process gas G10 exchanges heat with the mixed gas G3, thereby being heated from about 20° C. to 30° C. and being gasified. For that reason, the gas-state process gas G1 is supplied to the compressor 3 via the process gas recovery line 34.

According to the gas recovery system 30 of one or more embodiments and the compressor system 2 and the refrigeration cycle system 1 including the same, the gas-state process gas G1 contained in the mixed gas G3 discharged from the compressor 3 is cooled until the gas-state process gas G1 is liquefied by the cooling section 32, and is separated into the gas-state second seal gas G2 by the separating section 33. That is, the process gas G1 and the second seal gas G2 in the mixed gas G3 can be separated by cryogenically separating the mixed gas G3 with the cooling section 32 and the separating section 33. The liquid-state process gas G10 separated by the process gas recovery line 34 is gasified and s returned to the compressor 3. For that reason, the process gas G1, which has leaked as a first seal gas and has been used in the leakage preventing seal portion 15, can be returned to and reused for the compressor 3. Hence, the amount of the process gas G1 to be additionally supplied to the compressor 3 can be reduced. Accordingly, the running cost of the compressor 3 and the compressor system 2 and the refrigeration cycle system 1 including the same can be reduced.

By using the LNG in order to cool and condense the mixed gas G3 in the cooling section 32, cryogenic separation can be performed at an ultralow temperature and at a low pressure. It is not necessary to raise the pressure of the mixed gas G3 in which an inert gas is mixed can be raised, to raise the condensation temperature thereof, and the cryogenic separation can be performed at a low pressure. For that reason, the gas-state process gas G1 can be efficiently brought into a liquid state without liquefying most of the second seal gas G2 in the mixed gas G3. Hence, the recovery efficiency of the process gas G1 in the mixed gas G3 can be improved.

Since the partial pressure of the mixed gas G3 in which the gas-state process gas G1 and the second seal gas G2 are pressed in a mixed manner drops, the condensation temperature thereof become lower compared to the case of the process gas G1 as a single substance. Particularly, in a case where the second seal gas G2 is nitrogen, there is a concern that the ratio thereof contained in the mixed gas G3 may become high and the condensation temperature thereof may become very low. For that reason, the mixed gas G3 can be cryogenically separate without being raised in pressure by using the ultralow temperature LNG.

Particularly, in a case where the gas recovery system 30 of the compressor 3 is used in the LNG plants as in one or more embodiments, the ultralow temperature LNG can be easily supplied to the cooling section 32. For that reason, with respect to the cooling section 32, it becomes unnecessary to newly prepare a cold source for cooling the mixed gas G3 or prepare a large-scale device. As a result, the gas recovery system 30 of the compressor 3 can be configured with simple components.

Since the cooling section 32 is provided over the mixed gas supply line 31 and the process gas recovery line 34, the liquid-state process gas G10 can be heated while cooling the mixed gas G3 by performing heat exchange between the mixed gas G3 and the liquid-state process gas G10. Hence, the cold energy when cooling the mixed gas G3 can be recovered and can be effectively used as the energy for heating the liquid-state process gas G10.

Since the cooling section 32 is provided over the mixed gas supply line 31, the process gas recovery line 34, and the refrigerant supply line 35, the mixed gas G3 can be made to perform heat exchange with not only the LNG but also the liquid-state process gas G10. For that reason, the cooling efficiency of the mixed gas G3 in the cooling section 32 can be improved further than in the case of only the LNG. As a result, the amount of supply of the LNG to be supplied in the cooling section 32 can be suppressed.

The condensation temperature of the process gas G1 contained in the mixed gas G3 can be raised by raising the pressure of the mixed gas G3 with the first compressor 37 before being supplied to the cooling section 32. For that reason, the temperature at which the gas-state process gas G1 is cooled by the cooling section 32 for condensation can be suppressed. Hence, the cooling efficiency when liquefying the process gas G1 by the cooling section 32 can be improved.

Since the position of the liquid level of the liquid-state process gas G10 in the separating section 33 is kept constant, the liquid-state process gas G10 can be reliably supplied from the separating section 33 to the process gas recovery line 34. Hence, the gas-state second seal gas G2 within the separating section 33 can be prevented from being mixed into the process gas recovery line 34.

Figure 4:
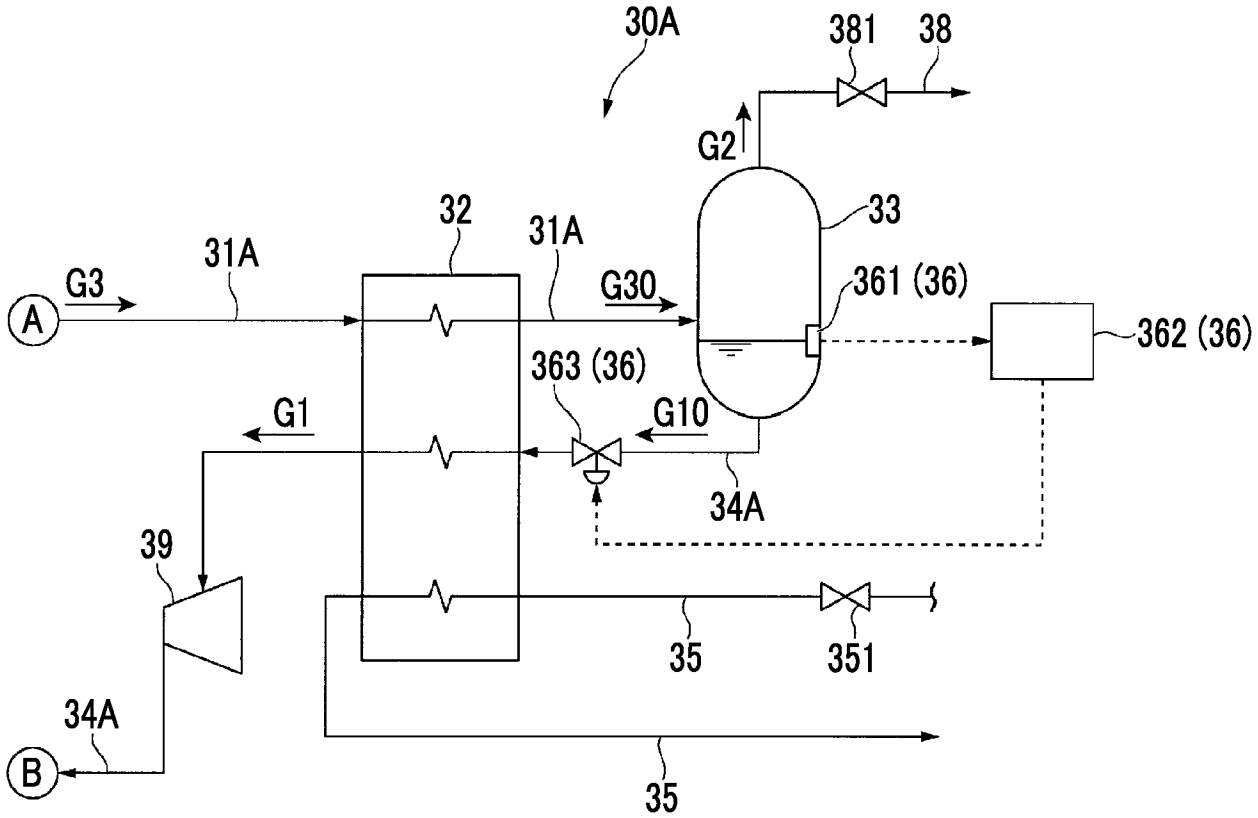
FIG. 4 is a schematic view illustrating a gas recovery system related to one or more embodiments of the present invention.

Next, a gas recovery system of one or more embodiments will be described with reference to FIG. 4.

In these embodiments, the same constituent elements as those of the previously described embodiments will be designated by the same reference signs, and the detailed description thereof will be omitted. The gas recovery system of one or more embodiments below is different from that of the embodiments above in that a compressor is provided in the process gas recovery line instead of the mixed gas supply line.

A gas recovery system 30A of one or more embodiments includes a mixed gas supply line 31A that is not provided with the first compressor 37, the cooling section 32, the separating section 33, the process gas recovery line 34 provided with a second compressor 39, the supply adjustment section 36 that adjusts the amount of supply of the process gas G1 to the second compressor 39, and the refrigerant supply line 35.

Similarly to the previously described embodiments, the mixed gas supply line 31A connects the primary vent 18 of the compressor 3 and the separating section 33 together via the cooling section 32. The first compressor 37 is not provided on the way in the mixed gas supply line 31A of one or more embodiments, and the mixed gas G3 discharged from the primary vent 18 passes through the cooling section 32 without being raised in pressure, and is connected to the separating section 33.

Similarly to the previously described embodiments, the process gas recovery line 34A is connected to the lower part of the separating section 33 and is supplied to the compressor 3 after the liquid-state process gas G10 accumulated at the lower part of the separating section 33 is circulated and gasified. The second compressor 39 that compresses the gas-state process gas G1 is provided on the downstream side (compressor 3 side) of than the cooling section 32 in the process gas recovery line 34A.

The second compressor 39 compresses the gas-state process gas G1 after being cooled by the cooling section 32 and before being supplied to the compressor 3. The second compressor 39 raises the pressure of the process gas G1 until the pressure of the process gas G1 becomes approximately equal to the pressure in the compressor 3. The gas-state process gas G1 compressed by the second compressor 39 is supplied to the compressor 3 via the process gas recovery line 34A.

According to the one or more embodiments, in a case where it may be preferable to cryogenically separate the low-pressure mixed gas G3 in the cooling section 32, the low-pressure process gas G1 can be returned into the compressor 43 system by being raised in pressure by the second compressor 39 after the cryogenic separation. Hence, it is possible to return the separated process gas into a high-pressure compressor while setting the low-pressure mixed gas supplied from the compressor 3 to pressure conditions such that the cryogenic separation becomes optimal.

Although one or more embodiments of the present invention have been described above in detail with reference to the drawings, the respective components, combinations thereof, or the like are exemplary. Additions, omissions, substitutions, and other modifications of the components can be made without departing from the spirit of the invention. Additionally, one or more embodiments of the present invention should not limited by the above examples and should be limited only by the scope of the claims.

In addition, the cooling section 32 is not limited to being disposed over three including the mixed gas supply line 31, 31A, the process gas recovery line 34, 34A, and the refrigerant supply line 35, and is sufficient if the cooling section can cool the mixed gas G3 flowing through the mixed gas supply line 31, 31A. Additionally, the cooling section 32 may be disposed over only two including the mixed gas supply line 31, 31A and the refrigerant supply line 35 and may cool the mixed gas G3 only with the LNG. In this case, in order to gasify the liquid-state process gas G10, another heater (heat source) may be prepared for the process gas recovery line 34, 34A.

Additionally, the cooling section 32 is not limited to a structure that exchanges heat with the LNG and may cool the mixed gas G3 at a lower temperature than the condensation temperature of the process gas G1. The cooling section 32 may circulate liquefied carbon or liquefied nitrogen instead of the LNG through the refrigerant supply line 35 to exchange heat or may be a structure that cools the mixed gas G3 using devices, such as a refrigerator, without using the refrigerant supply line 35.

The gas recovery system 30, 30A is not limited to a configuration having only the first compressor 37 or a configuration having only the second compressor 39 and may have both the first compressor 37 and the second compressor 39.

INDUSTRIAL APPLICABILITY

According to the gas recovery system 30A of the above-mentioned compressor 3, by separating the process gas G1 from the mixed gas G3 to return the process gas G1 to the compressor 3, the amount of the process gas G1 to be additionally supplied to the compressor 3 can be reduced, and the running cost of the compressor 3 can be reduced.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

REFERENCE SIGNS LIST

1: REFRIGERATION CYCLE SYSTEM
2: COMPRESSOR SYSTEM
3: COMPRESSOR
4: CONDENSER
5: STORAGE SECTION
6: EVAPORATOR
7: DRIVING MACHINE
8: VALVE
10: SEAL PORTION
11: ROTOR
12: STATOR
13: ROTARY SHAFT
14: BEARING
15: LEAKAGE PREVENTING SEAL PORTION
16: LABYRINTH SEAL
16A: FIRST LABYRINTH SEAL
16B: SECOND LABYRINTH SEAL
17: DRY GAS SEAL
17A: FIRST DRY GAS SEAL
17B: SECOND DRY GAS SEAL
18: PRIMARY VENT
19: SEPARATION SEAL
20: SECONDARY VENT
21: EXTERNAL SUPPLY SOURCE
S1: FIRST SPACE
S2: SECOND SPACE
S3: THIRD SPACE
S4: FOURTH SPACE
G1: GAS-STATE PROCESS GAS
G2: SECOND SEAL GAS (INERT GAS)
G3: MIXED GAS
G30: SECOND MIXED GAS
G4: SEPARATION GAS
G10: LIQUID-STATE PROCESS GAS
30, 30A: GAS RECOVERY SYSTEM
31, 31A: MIXED GAS SUPPLY LINE
32: COOLING SECTION
33: SEPARATING SECTION
34, 34A: PROCESS GAS RECOVERY LINE
35: REFRIGERANT SUPPLY LINE
36: SUPPLY ADJUSTMENT SECTION
361: DETECTING UNIT
362: CONTROL UNIT
363: CONTROL VALVE
37: FIRST COMPRESSOR
38: GAS DISCHARGE LINE
39: SECOND COMPRESSOR

The invention claimed is:

1. A gas recovery system that separates a mixed gas, in which a process gas compressed by a compressor and an inert gas supplied to a seal portion of the compressor are mixed together, into the process gas and the inert gas, the gas recovery system comprising:

a cooling section that cools and liquefies the process gas contained in the mixed gas by cooling the mixed gas at a temperature that is higher than a condensation temperature of the inert gas and lower than a condensation temperature of the process gas;

a separating section that separates the mixed gas cooled in the cooling section into the process gas in a liquid state and the inert gas in a gas state; and a process gas recovery line that is connected to the separating section and that circulates and gasifies the liquid-state process gas and then supplies the process gas into the compressor.

2. The gas recovery system according to claim 1, wherein the cooling section cools the mixed gas by exchanging heat between a liquefied natural gas and the mixed gas.

3. The gas recovery system according to claim 1, wherein the cooling section cools the mixed gas by exchanging heat between the liquid-state process gas that flows through the process gas recovery line, and the mixed gas.

4. The gas recovery system according to claim 1, further comprising:

a first compressor that compresses the mixed gas before being supplied to the cooling section.

5. The gas recovery system according to claim 1, further comprising:

a second compressor that compresses the process gas in a gas state that flows through the process gas recovery line.

6. The gas recovery system according to claim 1, wherein the separating section stores the separated liquid-state process gas, and wherein the gas recovery system further includes a supply adjustment section that supplies the liquid-state process gas to the process gas recovery line such that the liquid level of the liquid-state process gas is maintained at a certain position in the separating section.

7. A compressor system comprising:

a compressor; and the gas recovery system according to claim 1.

8. A refrigeration cycle system comprising:

the compressor system according to claim 7.

* * * * *